US005598879A

United States Patent [19]

Chen

[11] Patent Number: 5,598,879

[45] Date of Patent: Feb. 4, 1997

[54] RECEIVING MEANS OF A WOOD WORKING MACHINE

[76] Inventor: Ruey-Zon Chen, No. 261, Jen Hwa Rd., Tali City, Taichung, Taiwan

[21] Appl. No.: 502,987

[22] Filed: Jul. 18, 1995

[51] Int. Cl.[6] ..... B25H 3/02

[52] U.S. Cl. ..... 144/285; 144/286.1; 206/349; 312/293.3

[58] Field of Search ..... 144/1.1, 285, 286.1, 144/286.5; 206/349, 372, 373, 376, 379; 312/293.1, 293.3

[56] References Cited

U.S. PATENT DOCUMENTS

| | | | |
|---|---|---|---|
| 4,408,642 | 10/1983 | Jenuzal et al. | 144/286 A |
| 4,953,601 | 9/1990 | Herdies | 144/286 A |
| 5,056,572 | 10/1991 | Del Vacchio | 144/286 A |
| 5,351,730 | 10/1994 | Lewellen et al. | 144/286 A |

*Primary Examiner*—W. Donald Bray
*Attorney, Agent, or Firm*—Bacon & Thomas

[57] ABSTRACT

A receiving device of a wood working machine which has a base and the base has a flange extending horizontally therefrom, two skirt portions and a corner skirt respectively extending vertically from the flange so as to define two recessed portions between the base and the skirt portions and the corner skirt for receiving suitable tools or knives therein, the base having a box disposed to one side thereof for receiving a gauge means therein and having a recess defined therein by two side boards, a vertical board and a bottom, each of the side boards having a slot and the vertical board having two cavities respectively defined therein, a cover slidably moved in the two slots by two sides thereof, each of the sides having a hook-like element and a protrusion extending laterally therefrom, a stop extending downwardly from a front wall portion of the base to partially cover an open end of the slot so as to prevent the cover from being completely removed from the base.

7 Claims, 3 Drawing Sheets

RECEIVING MEANS OF A WOOD WORKING MACHINE

BACKGROUND OF THE INVENTION

1. Field of Invention

The present invention relates to a receiving means and more particularly, to a receiving means disposed to a base of a wood working machine for tools or parts received therein.

2. Related Prior Art

A conventional wood working machine generally has a base on which a bench and a wood working mechanism are disposed, there are many kinds of tools or parts needed, such as a gauge means, spanners and knives, when an operator operates the wood working machine, however, the tools and parts are often randomly put on the bench or other places because of lacking suitable receiving means which has a convenient access, therefore, it takes time to find them when needed again. Furthermore, a randomly put of the gauge means or the knives often results in a misalignment or a damage thereof thus an accuracy of the production of the work pieces is severely affected.

The present invention intends to provide a receiving means which is disposed to the base of the wood working machine, the receiving means including a recess which has a slidable cover disposed thereabove, a plurality of recessed portions defined by skirt portions and a corner skirt both extending vertically from a flange of the base and a box, the recess, the box and each of the recessed portions suitable for receiving parts, certain tools or knives so as to mitigate and/or obviate the above-mentioned problems.

SUMMARY OF THE INVENTION

The present invention provides a receiving means of a wood working machine which base has a flange extending horizontally therefrom and two skirt portions and a corner skirt respectively extend vertically from the flange so as to define recessed portions between the skirt portions and the corner skirt for receiving suitable tools or knives therein, the base having a box disposed to one side thereof for receiving a gauge means therein and having a recess defined therein by two side boards, a vertical board and a bottom, each of the side boards having a slot and the vertical board having two cavities respectively defined therein, a cover slidably moved in the two slots by two sides thereof, each of the sides having a hook-like element and a protrusion extending laterally therefrom, a stop extending downwardly from a front wall portion of the base to partially cover an open end of the slot so as to prevent the cover from being completely removed from the base, It is an object of the present invention to provide a receiving means of a wood working machine for receiving tools or parts therein and the receiving means including a plurality of recessed portions, a box and a recess which having a cover disposed thereto and the cover is not completely removed from the base when pulled the cover downwardly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
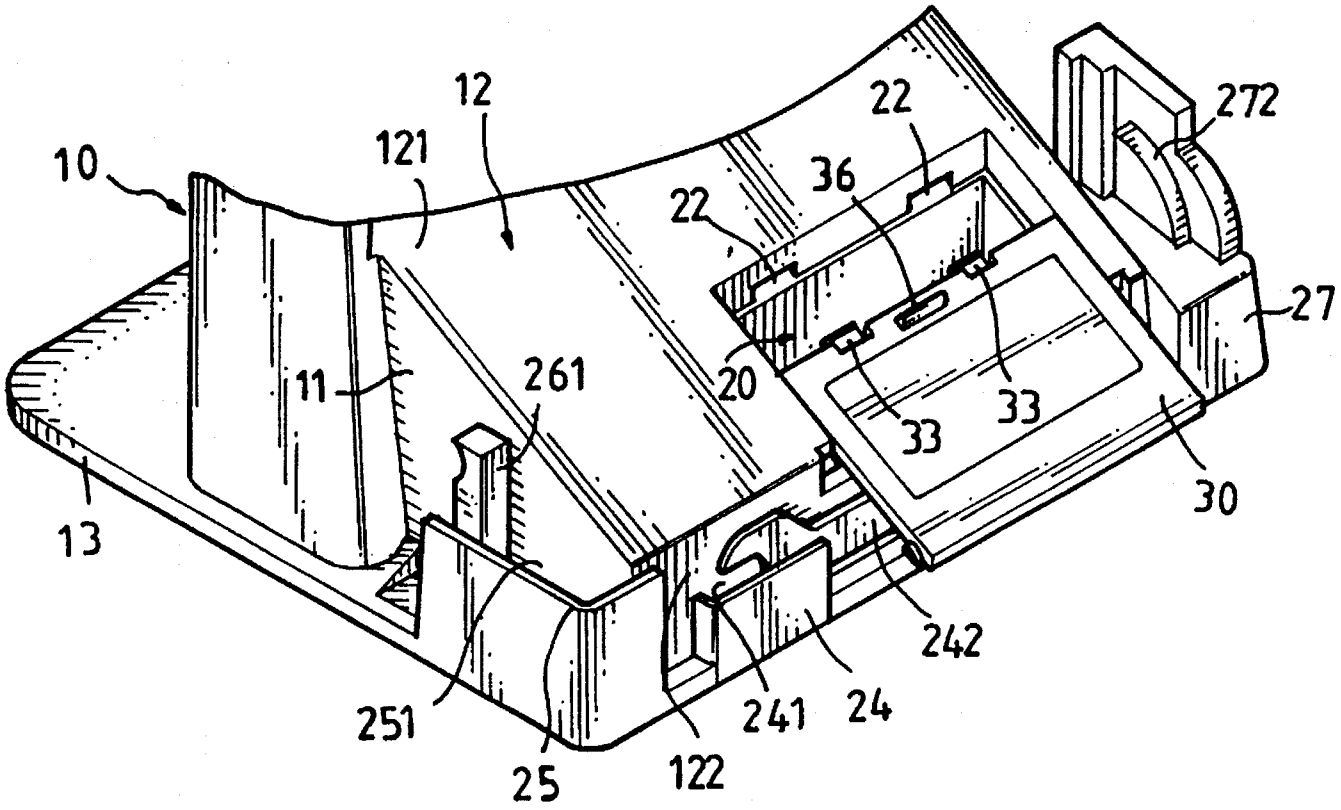
FIG. 1 is a perspective view of a base with a receiving means disposed thereto in accordance with the present invention.
Figure 2:
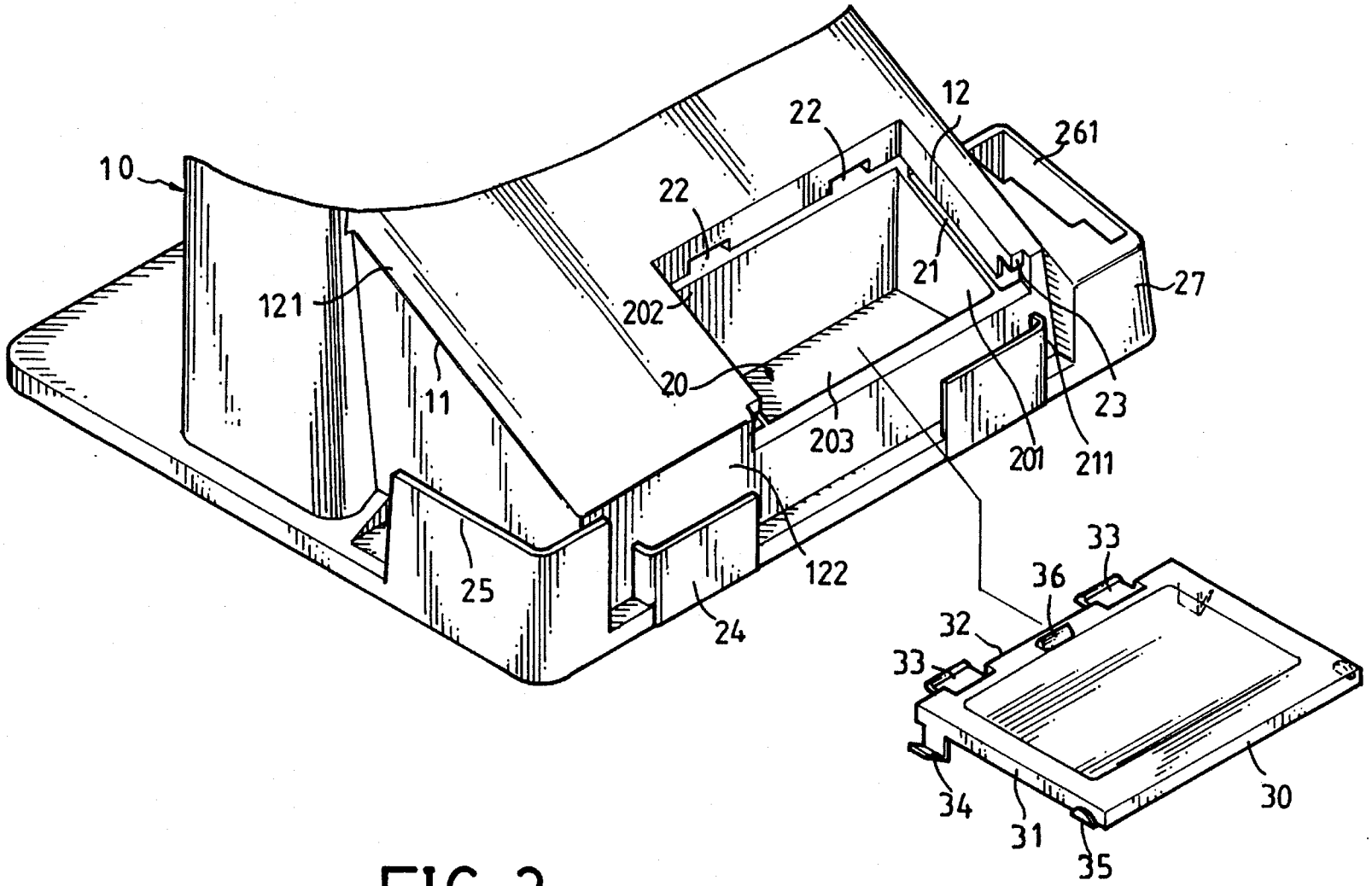
FIG. 2 is an exploded view of a cover and the base in accordance with the present invention.
Figure 4:
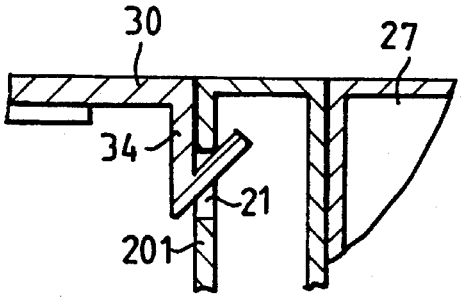
FIG. 4 is a cross-sectional view of an engagement of the hook-like element received in the slot defined in the side board.

Referring to the drawings and initially to FIGS. 1 and 2, a wood working machine generally includes a base 10 on which a bench (not shown) and a wood working mechanism (not shown) are respectively disposed, the base 10 having two side walls 11 and a front wall portion 12, the front wall portion 12 including an inclined front wall 121 and a vertical wall 122 which integrally extends from the inclined front wall 121. The receiving means in accordance with the present invention includes a box 27 disposed to one of the side walls 11, a first recessed portion 241, a second recessed portion 251 and a recess 20. The recess 20 is defined in the front wall 121 and which is defined by two side boards 201, a vertical board 202 and a bottom 203, each of the side boards 201 having a slot 21 defined therein and the vertical board 202 having two cavities 22 defined therein. A cover 30 has two sides 31 and a front end 32, each of the sides 31 having a first end and a second end, the first end thereof having a hook-like element 34 extending laterally therefrom and the second end thereof having a protrusion 35 extending laterally therefrom, both of the hook-like element 34 and the protrusion 35 slidably received in the corresponding slot 21 of the recess 20 as shown in FIG. 4, the front end 32 of the cover 30 having two extensions 33 extending longitudinally therefrom for being received in the cavities 22. A stop 23 extends downwardly from the inclined front wall 121 to partially cover an open end of the slot 21 such that the hook-like element 34 is limited by the stop 23 when the cover 30 is slid to open the recess 20 and therefore prevents the cover 30 from being completely removed from the base 10. The cover 30 has a block 36 extending upwardly from an upper surface thereof for a user pulls the cover 30 thereby.

Figure 3:
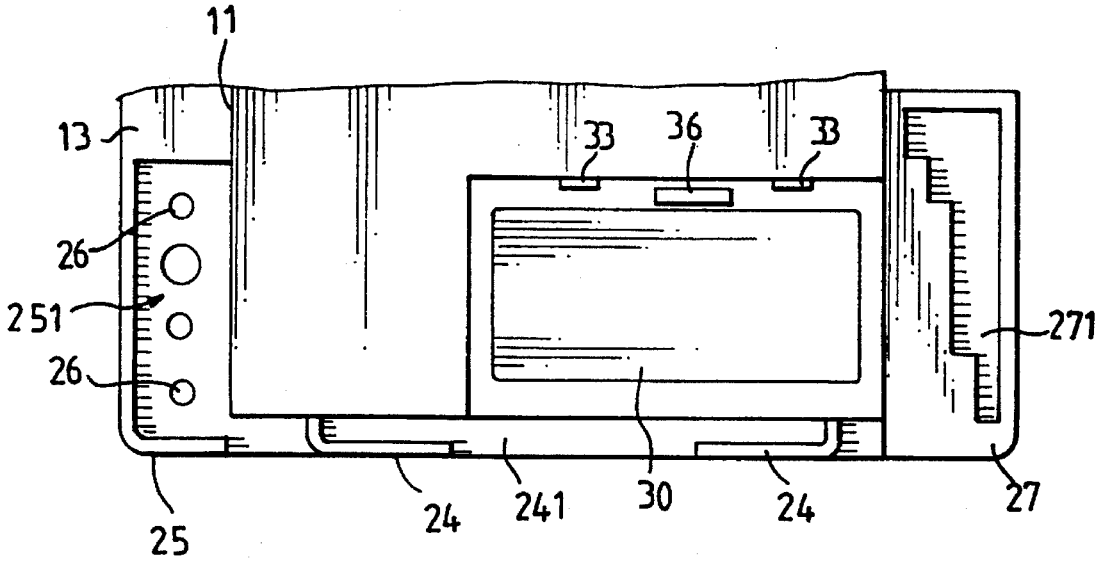
FIG. 3 is a top plane view of the base with the receiving means in accordance with the present invention.

Referring to FIG. 3, the base 10 has a flange 13 extending horizontally from a bottom thereof, two skirt portions 24 extending upwardly from the flange 13 corresponding to the vertical wall 122 so as to define the first recessed portion 241 between the skirt portions 24 and the vertical wall 122 of the front wall portion 12 of the base 10. The first recessed portion 241 is sized to receive a tool, such as a spanner 242 therein. A corner skirt 25 extends upwardly from a corner of the flange 13 so as to define the second recessed portion 251 between the base 10 and the corner skirt 25, a bottom of the second recessed portion 251 has a plurality of receiving recesses 26 defined therein, each of the receiving recesses 26 is sized to receive a certain tool therein such as a knife 261. The box 27 is disposed to the side wall 11 of the base 10, the box 27 having a recess 271 with a certain shape for a tool such as a gauge 272 received therein.

Accordingly, the present invention provides the receiving means which has a feature of having a suitable receiving space for tools or parts which are frequently used to be received therein.

Although the invention has been explained in relation to its preferred embodiment, it is to be understood that many other possible modifications and variations can be made without departing from the spirit and scope of the invention as hereinafter claimed.

I claim:

1. A tool storage device for a wood working machine, comprising: a base on which a bench and a wood working mechanism are respectively disposed, said base having two side walls, a front wall and a rear wall, said front wall including an inclined front wall portion and a vertical wall portion which integrally extends from said inclined from wall portion, said inclined front wall portion having a recess therein which is bounded by two side boards, a vertical board and a bottom, each of said side boards having a slot therein and said vertical board having two cavities therein; a cover having two sides and a front end, each of said sides having a first end and a second end, said first end thereof having a hook element extending laterally therefrom and said second end thereof having a protrusion extending laterally therefrom, both of said hook elements and said protrusions slidably received in said slot of said side board, said front end of said cover having two extensions extending longitudinally therefrom being received in said cavities; and a stop extending downwardly from said inclined front wall to partially cover an open end of said slots such that said hook element is limited by said stop when said cover is slid to open said recess.

2. The tool storage device for a wood working machine as claimed in claim 1 wherein said cover has a block extending upwardly from an upper surface thereof.

3. The tool storage device for a wood working machine as claimed in claim 1 wherein said base has a flange extending horizontally from a bottom thereof, and at least one skirt portion extending upwardly from said flange so as to define a first recessed portion between said skirt portion and said vertical wall portion of said front wall of said base.

4. The tool storage device for a wood working machine as claimed in claim 1 wherein said base has at least one box disposed on one side thereof.

5. The tool storage device for a wood working machine as claimed in claim 4 wherein said box has a recess defined therein.

6. The tool storage device for a wood working machine as claimed in claim 3 wherein said flange has a corner skirt extending vertically therefrom so as to define a second recessed portion between said base and said corner skirt.

7. The tool storage device for a wood working machine as claimed in claim 6 wherein said second recessed portion has a bottom in which a plurality of receiving recesses are defined therein.

* * * * *